US006474911B1

(12) United States Patent
Krings

(10) Patent No.: US 6,474,911 B1
(45) Date of Patent: Nov. 5, 2002

(54) TRENCH SHEETING DEVICE

(75) Inventor: Josef Krings, Heinsberg (DE)

(73) Assignee: Wolfgang Richter, Hürtgenwald (DE)

( * ) Notice: Subject to any disclaimer, the term of this patent is extended or adjusted under 35 U.S.C. 154(b) by 0 days.

(21) Appl. No.: 09/646,820

(22) PCT Filed: Mar. 12, 1999

(86) PCT No.: PCT/DE99/00719

§ 371 (c)(1),
(2), (4) Date: Sep. 22, 2000

(87) PCT Pub. No.: WO99/49144

PCT Pub. Date: Sep. 30, 1999

(30) Foreign Application Priority Data

Mar. 26, 1998 (DE) ..... 198 13 282

(51) Int. Cl.[7] ..... E02D 29/02; E02D 5/00
(52) U.S. Cl. ..... 405/282; 405/283; 405/272
(58) Field of Search ..... 405/282, 272, 405/276, 279, 283, 298, 300

(56) References Cited

U.S. PATENT DOCUMENTS

| | | | | | |
|---|---|---|---|---|---|
| 3,750,409 | A | * | 8/1973 | Orfei | 61/41 |
| 3,788,086 | A | * | 1/1974 | West, Jr. | 61/41 A |
| 4,033,138 | A | * | 7/1977 | Griswold | 61/41 A |
| 4,114,383 | A | * | 9/1978 | Nieber | 405/282 |
| 4,310,267 | A | * | 1/1982 | Davis | 405/283 |
| 4,345,857 | A | * | 8/1982 | Krings | 405/282 |
| 4,378,923 | A | * | 4/1983 | Takei | 248/68 R |
| 4,659,260 | A | * | 4/1987 | Morelli | 405/283 |
| 5,259,705 | A | * | 11/1993 | Breaux et al. | 405/267 |
| 5,310,289 | A | * | 5/1994 | Hess | 405/282 |
| 5,595,459 | A | * | 1/1997 | LoMonaco | 405/272 |
| 5,741,091 | A | * | 4/1998 | St. George | 405/283 |
| 5,839,707 | A | * | 11/1998 | Barringer | 248/214 |
| 5,865,567 | A | * | 2/1999 | Wilkinson | 405/283 |
| 5,885,033 | A | * | 3/1999 | Krings | 405/282 |

FOREIGN PATENT DOCUMENTS

| | | |
|---|---|---|
| EP | 0 027 576 | 4/1981 |
| EP | 0 748 899 | 12/1996 |
| GB | 1 407 799 | 9/1975 |

* cited by examiner

*Primary Examiner*—Thomas B. Will
*Assistant Examiner*—Raymond W Addie
(74) *Attorney, Agent, or Firm*—Collard & Roe, P.C.

(57) ABSTRACT

A trench sheeting device consists of trench sheeting boxes which are each made up of two trench plates supported against each other, the width of the trench apart, and at least one shaft sheeting box whose width exceeds that of the trench. The shaft sheeting box can therefore essentially be introduced into the ground with standard trench plates and with essentially the same elements as a plate of that type, that is, practically in one piece. To this end, the shaft sheeting box consists of a trench plate on each longitudinal shaft wall and shaft plates which are arranged at the longitudinal ends of the trench plates connected to the adjoining trench sheeting boxes, in such a way that they cannot move. The shaft plates are therefore positioned cross-wise to the longitudinal direction of the trench and the trench plates and are relatively narrow compared to the trench plates.

6 Claims, 4 Drawing Sheets

TRENCH SHEETING DEVICE

Figure 1:
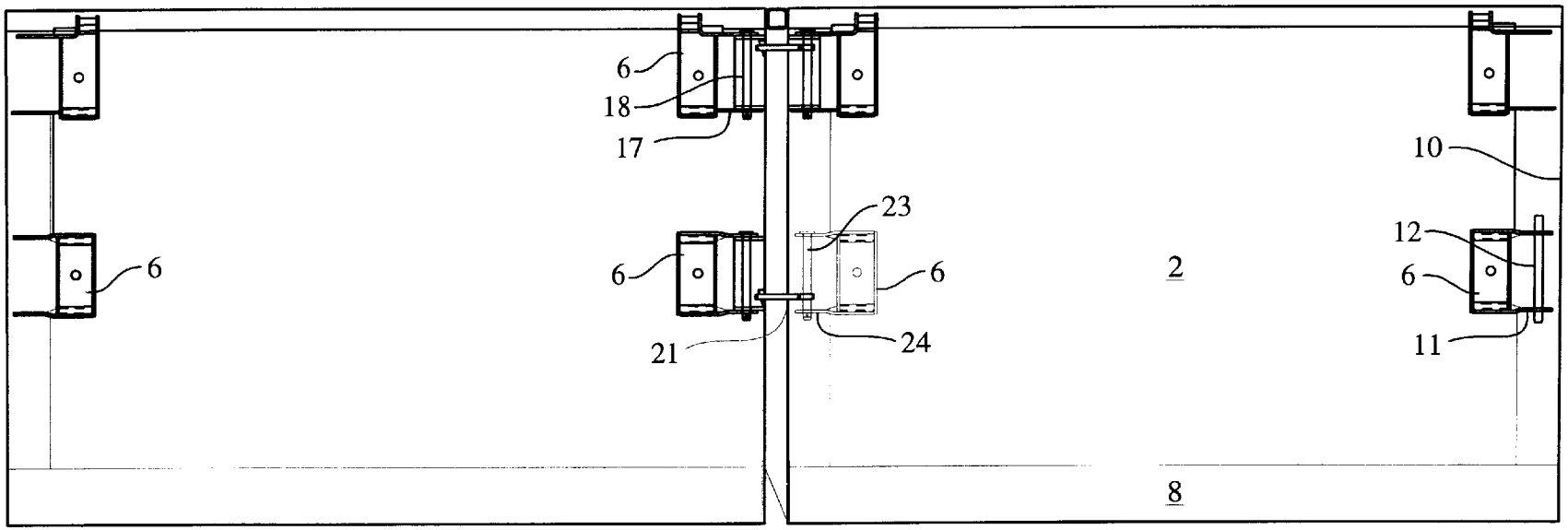

The invention relates to a trench sheeting device consisting of trench sheeting boxes that are each made up of two standard trench plates that are supported against each other, the width of the trench apart, with the help of spindle spreaders, said device having at least one shaft sheeting box whose width exceeds the width of the trench, measured crosswise in relation to the longitudinal direction of the trench and comprises a standard trench plate on each wall of the shaft, as well as shaft plates detachably attached upright to the longitudinal ends of each of the trench plates transversely in relation to the longitudinal direction of the trench, said detachable shaft plates being coupled with the trench plates of an adjoining trench sheeting box after they have been driven into the ground.

In trench sheeting, for example for laying pipeline ducts, trench plates are supported against each other in pairs with the help of spindle spreaders. The individual trench plate generally has a rectangular shape. At its bottom, which has to be driven into the ground, it has a blade, and at the top edge opposing the blade, thus on the so-called anvil edge, it is provided with a stability such that it can be driven into the ground with the shovel of the excavator. On the side edges, which extend about vertically after it has been installed, such a trench plate may have tabs for connecting it with trench plates disposed adjacent to it in the longitudinal direction of the trench, such tabs generally being located on the inside surface facing the trench and being solidly molded onto, in particular welded to the side edges. In addition, provision is made on the inside surfaces of each trench plate for bearing positions for receiving the spindle spreaders. A spindle spreader is a punch that has a screw spindle, for example in the center. The punch can be made longer or shorter with the help of such a screw spindle. For forming a trench sheeting box, a pair of trench plates is generally stabilized by four spindle spreaders.

Trenches, often several meters deep, on whose bottom tube ducts, for example for waste water canals have to be installed, are produced with the help of a trench sheeting device that weighs tons. Inspection shafts are required along the course of a canal at defined intervals. Such shafts are often constructed of brickwork and their diameter is in general substantially larger than the diameter of the respective pipeline. Over the major part of its length, i.e. where only the canal tubes have to be laid, the trench, for reasons of savings, is made just wide enough as required for laying the canal tubes. Such a trench width is in most case not sufficient to allow the construction of an inspection shaft, in whose location the spacing measured crosswise in relation to the, longitudinal direction of the trench plates that are supported against each other, needs to be substantially larger than in the remaining part of the trench. In practical life, the transition from the normal width of the trench to the greater width required for the shaft poses problems. Since investments for special parts for producing a shaft box enclosing the location of an inspection shaft to be built are preferably avoided, all sorts of risky auxiliary means are often employed for supporting the site of the shaft. As an alternative, the trench is often constructed already with a spacing provided from the location intended for the inspection shaft by expanding it to the width of the shaft, to begin with. This means that either the risk of collapse is posed, or that considerably more soil has to be carted off than would be actually required for constructing the canal and the shaft.

A trench sheeting device which possibly may comprise an integrated shaft sheeting box is disclosed in EP-A-0 027 576. According to said published document, an expansion can be installed in a number of trench sheeting boxes having a normal width. Trench plates (sheeting plates) can be used on the sides of said expansion like in a trench having a normal width. For compensating the changing width of the trench, connecting pieces that can be lengthened like a telescope are used at the ends of the trench plates via vertically adjustable clamping shoes. The connecting pieces have bores at their longitudinal ends. Bolts are associated with the bores at the substantially vertical longitudinal ends of the (installed) trench plates. After the trench plates have been installed, each two adjacent longitudinal edges are coupled with each other by connecting two bolts that oppose each other on adjacent walls with one of the connecting pieces, whereby the two bores of the connecting piece are hooked up via the bolts. The horizontal spacing of the two bores can be adapted to the actual spacing of the bolts by changing a telescope that is integrated in the connecting piece. It is stated in the prior art that any vertical offset between adjacent installation plates can be compensated with the help of a vertically adjustable clamping connection consisting of a clamping shoe (on the one plate) and an associated clamping rail (on the other plate).

According to the aforementioned EP-A-0 027 576, it is possible in the manner described to compensate part of the inaccuracies that always occur when the trench plates are driven into the ground. However, for compensating driving-in inaccuracies in the direction of the depth, width and length of the trench, three different auxiliary means with screw and clamp connections that have to be mounted in the trench are required in the prior art. Such adapting means are unsuitable for the rough underground construction operations involving protection, rust and frequent bending stresses.

In addition to the connecting components which are difficult to assemble, it is necessary in the prior art according to the above-cited published document to drive a canal piling into the ground; however, gaps remain nonetheless open along the borderlines between the standard trench plates and the canal piling, through which sandy subsoil may trickle into the shaft. The known device, however, is not only difficult to assemble after it has been driven into ground: such assembly is often not possible at all, and, furthermore, it also requires much expenditure on account of the complicated telescopic component, and comprehensive stockkeeping of special parts is required because of the variety of individual parts.

The invention is based on the problem of providing a shaft sheeting box that has to be integrated in a normal trench sheeting construction, thus a sheeting construction consisting of standard trench plates. Such a shaft sheeting box can substantially make do with standard trench plates, so that the amount of soil to be excavated and the risk of collapse are minimized.

Furthermore, precautionary measures are to be implemented that permit compensating inaccuracies occurring when the shaft sheeting box or the preceding trench sheeting box are driven into the ground, using means suited to underground civil engineering.

The solution according to the invention for the trench sheeting device specified above, with trench sheeting boxes successively arranged along the trench, and with at least one shaft sheeting box, consists in that the shaft sheeting box, before it is driven into the ground, is set up upright with attached shaft plates as a structure with a U-shaped horizontal cross section appearing like one single part, and in that the coupling of each shaft plate with the adjoining trench plate consists of a vertically disposed first bolt as well as a second bolt, the latter being in each case horizontally movable versus the trench plate or the shaft plate and supported on the latter, and vertically movably connected with the first bolt. Some improvements and further developments of the invention are described in the dependent claims.

Therefore, a trench sheeting box as defined by the invention consists of two structures which, upon their installation, have an approximately U-shaped cross section, whereby the base lines of the U-shape formed by standard trench plates are maintained by conventional spindle spreaders at such a mutual spacing that the mutual spacing of the free ends of the U-legs opposing each other, which are the free vertical edges of the shaft plates, has approximately the same size as the normal width of the trench, such mutual spacing being the one of the trench plates in the normal part of the trench where only a tube has to be laid.

The shaft plates as defined by the invention are basically structured similar to standard trench plates; however, they are much narrower than the normal trench plates in the horizontal direction, measured on the plate in its set-up position. Also, in practical life, the utilization of such plates is not limited to their application in connection with shaft boxes; they are rather employed whereever trench plates with less than the normal length are needed. Therefore, a shaft sheeting box as defined by the invention can be assembled with the help of components available at the construction site.

According to the invention, the shaft plate is joined with the trench plate via a form-locked bolt-and-eye coupling in such a way that the structure comprising two shaft plates and one trench plate set up upright to form a "U" can be driven into the ground without being capable of moving within itself, acting rather like one single part. For said purpose, the shaft plate, like the trench plate, has a blade on the bottom edge. The coupling belonging to the shaft sheeting box, with the shaft plates to be attached to its two longitudinal ends, preferably consists of a bolt-plug connection, which is geometrically designed and adapted to the shape of the plate edges bordering on each other, in such a way that after the bolt has been plugged in, any mutual movement between the trench plate and the shaft plate is excluded.

An shaft sheeting box with two standard trench plates opposing one another, and with a total of four shaft plates immovably attached to the longitudinal ends of the trench plates, is set up in the upright position with the help of the spindle spreader for producing a shaft, and driven into the ground into the intended position adjoining the last preceding trench box, whereby the soil is excavated with an excavator to the required extent, or removed in some other way. For implanting the shaft sheeting box, it is made sure that the free ends of the U-legs (shaft plates) of the shaft sheeting box, said free ends facing each other, are positioned with as much accuracy as possible, adjoining the free longitudinal ends of the trench sheeting box, the latter having been implanted first. After this work operation has been completed, the free ends of the U-legs are coupled with the free ends of the trench plate of the neighboring trench sheeting box.

According to the invention, measures are implemented in the coupling site where the shaft box is coupled with the trench box, such measures permitting inaccuracies to be compensated that were caused when the shaft sheeting box was driven into the soil, or when the trench sheeting box was driven in first. Preferably, provision is made between the shaft plate and the adjacent trench plate for a coupling with a vertically disposed rail of the trench plate as well as a carriage, the latter being horizontally movable versus the shaft plate and supported on the latter, whereby the carriage has to be vertically movably connected with the rail (alternatively, the rail can be secured on the shaft plate and the carriage can be supported on the trench plate). Such a connection permits to compensate inaccuracies that are often in the order of magnitude of a few centimeters, both in the horizontal and vertical directions.

Said embodiment of the invention is made particularly simple if both the rail and the carriage are realized in the form of bolts, and if the bolt forming the carriage grips with an eye over the bolt forming the rail. If the eye encloses the rail with play, the coupling as defined by the invention is capable of producing the joint in said site in a stable way even if the plate planes are positioned in the ground turned angularly against each other. For compensating horizontal displacements of the shaft box versus the adjacent trench box, it may be favorable, furthermore, if the bolt forming the carriage grips through a horizontal slot of the shaft plate and is secured on the shaft side against the forces originating from the trench plate by an abutment (the aforementioned alternative is applicable also with respect to the slot, i.e. with an exchange between the trench and shaft plates).

Details of the invention are explained with the help of the schematic representation of exemplified embodiments. In the drawing, FIGS. 1 and 2 show an elevation and a top view of a trench sheeting with a shaft sheeting box neighboring on a normal trench sheeting box.

Figure 2:
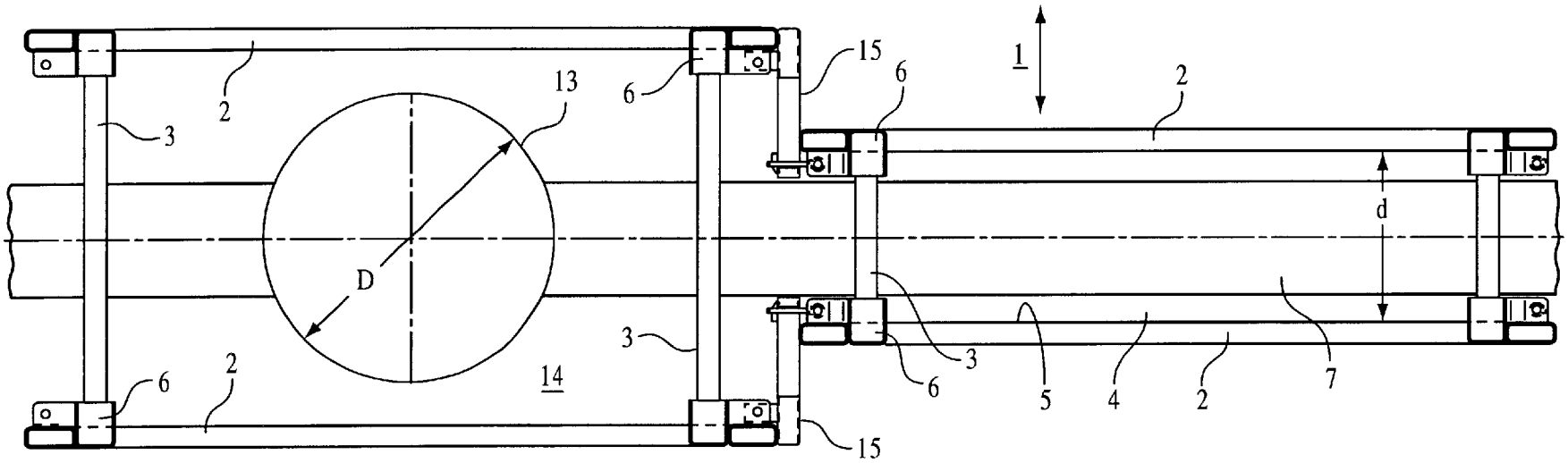
Figure 3:
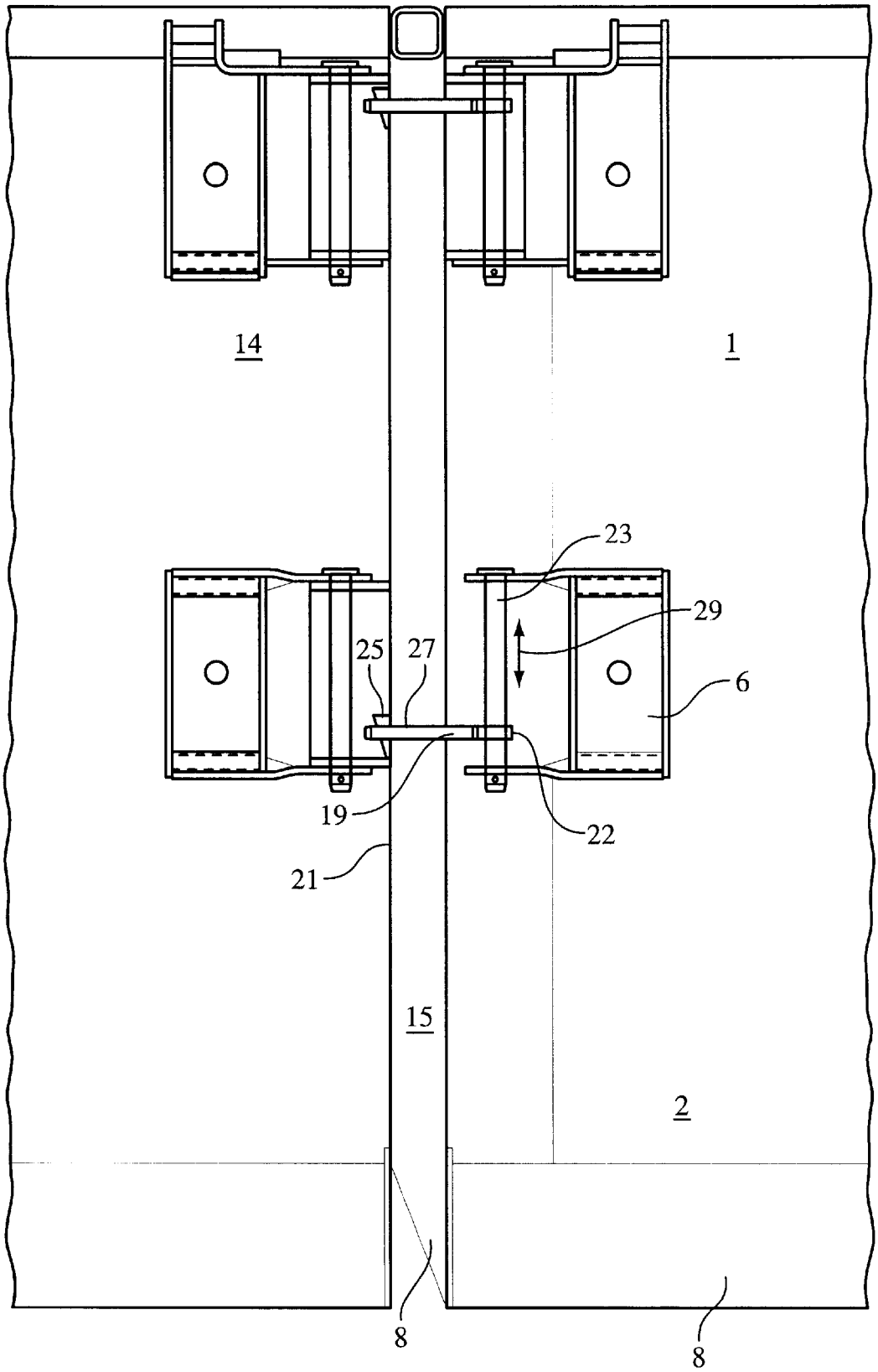
Figure 5:
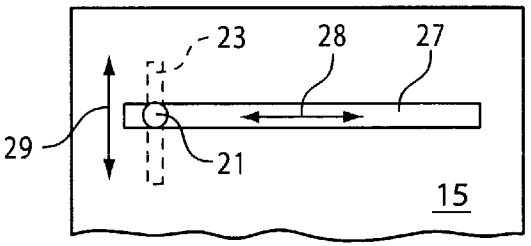
Figure 4:
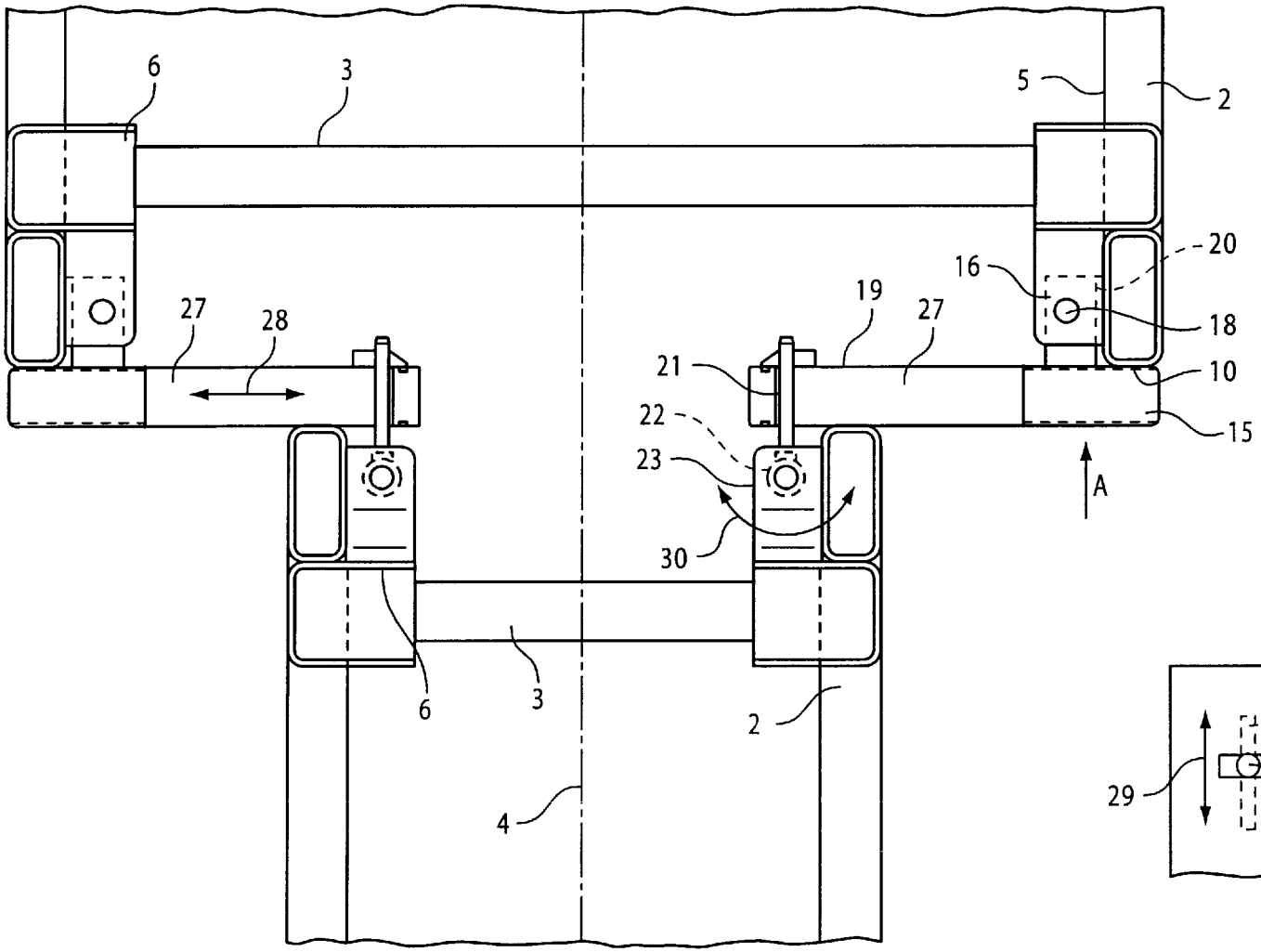

FIG. 3 shows an enlargement of the site of connection where the trench sheeting box and the shaft sheeting box according to FIG. 1 are joined; and FIGS. 4 and 5 show an enlarged top view of the site of connection where the trench sheeting box and the shaft sheeting box according to FIG. 2 are joined.

The invention is described in greater detail with the help of FIGS. 1 to 4. The trench sheeting device according to the exemplified embodiment consists of the trench sheeting boxes 1, which each are structured from a pair of the standard trench plates 2. The trench plates 2 are set up with the help of the spindle spreaders 3, which are received in the spreader bearings 6, for which provision is made in the inner surface 5 of the trench plates facing the trench 4. Two trench plates 2 are generally required for forming a trench sheeting box 2, said trench plates being supported against each other by the four spindle spreaders 3, the latter being received in the four spreader bearings 6 of each trench plate 2. The respective trench is made sufficiently wide (and deep) that a pipeline to be laid in the longitudinal expanse of length "L" of the trench, in particular a waste water canal 7, has room at the bottom of the trench. When the trench 4 is excavated, the trench plates 2 are driven into the ground, with the blade 9 provided at the lower end leading the way into the ground. For driving the trench plates into the ground, the shovel of the excavator employed, for example, is pressed against the top edge, which is the so-called anvil edge, of the respective trench plate 2. Each approximately rectangularly shaped trench plate has the two vertical longitudinal edges 10 once the trench plate has been set up, on which edges provision is made for devices, for example for the welded-on tabs 11 with bores, for example for a bolt 12. The trench sheeting boxes 1 installed adjacent to one another can be coupled with each other via the tabs 11 and the bolts 12, as well as via other connecting elements not shown.

Inspection shafts are needed in a canal 7 at defined intervals. Such inspection shafts consist of a bricked shaft 13, whose diameter "D" is generally larger than the internal width "d" of the trench 4 in the zone of a normal trench sheeting box 1, such internal width being required for laying a normal canal 7. Therefore, a shaft sheeting box is required in the sites where the shaft 13 is to be constructed. The shaft sheeting box according to the exemplified embodiment is denoted as a whole by reference numeral 14. Said shaft sheeting box consists of a pair of the standard trench plates 2 that are supported against each other by the usual spindle spreaders 3, said trench plates being disposed on the longitudinal shaft walls extending parallel with the longitudinal direction "L", and furthermore comprises the four (with a complete shaft sheeting box) shaft plates 15 that secure the transition between the wide shaft box 14 and the relatively narrow trench sheeting box 1.

For setting up the shaft sheeting box 14 according to the exemplified embodiment, the tongues 16 welded to the shaft plate 15 are connected with the tabs 17 provided in the inner surface 5 of the trench plate 2 by means of the bolts 18. This form-locked coupling assures that the longitudinal edge 10 of the trench plate 2 adjoining said tab 17 will be butt-jointed with the inner surface 19 of the trench plate 15 facing the shaft, and that the tongue 16 rests with a longitudinal edge 20 against the inner surface 5 of the trench plate 2. A unilateral movement of the shaft plate 15 and the trench plate 2 is not possible under said circumstances. In general, provision is made along the longitudinal edge 10 for at least two connections, each having a bolt 12 as shown in FIGS. 1 and 3.

A shaft sheeting box consisting of two trench plates 2 and four shaft plates 15, such shaft sheeting box being set up in an upright position with the help of generally four spindle spreaders 3, is lowered into the ground in a way similar to the installation of a set-up trench sheeting box 1. Once the shaft sheeting box 15 has reached its final position, it is coupled with the vertical longitudinal edges 10 of the adjacent trench sheeting box 1, as it is particularly shown with the help of the enlarged representations in FIGS. 3 to 5. A trench sheeting box adjoining a shaft sheeting box is, of course, coupled in a similar way. Such couplings must permit an adaptation to inaccuracies caused when the shaft sheeting box 14 and the trench sheeting box 1 were driven into the ground in vertical and, respectively, horizontal directions. In the rough circumstances of the construction work and because of unpredictable structures of the ground as such, it is generally not possible to realize exact to-the-centimeter positioning of the components of the trench sheeting box 1 and the shaft sheeting box 14 to be joined. For cases in which the trench sheeting box 1 is driven into the ground to a different depth than the shaft sheeting box 14, provision is made for a coupling that permits a permanent connection between the boxes 1 and 14 in the presence of correspondingly dimensioned vertical level differences. For said purpose, provision is made in the exemplified embodiment according to FIG. 3 for an eye screw 21, i.e. a bolt with an eye 22 through which a bolt 23 can be inserted. The bolt 23 according to the exemplified embodiment is received in tabs provided near a longitudinal edge 10 of a trench plate 2, so that said bolt substantially extends vertically after the installation (in the ground). The eye screw 21 is pulled through the shaft plate 15 and retained on the inner side 19 of said shaft plate with an abutment 25, for example with a screw or a wedge, in such a way that the eye screw 21 produces in said site a fixed permanent joint between the longitudinal end 10 of the trench plate 2 and the shaft plate 15 at least after the abutment 25 has been tightened against the outer surface 236 facing the soil. Before the abutment 25 is tightened, the eye screw 21 can be displaced with its eye 22 on the bolt 23 in such a way that the eye screw 21 can be plugged through the opening of the shaft plate 15 associated with it without any problems. Said opening permits within the framework of the invention an adaptation of the coupling to inaccuracies, if any, with respect to the horizontal association of the boxes 1 and 14 to be joined, because the opening associated in the shaft plate 15 with the eye screw 21 is realized not in the form of a hole, but as a slot 27. In said slot 27, the eye screw 21 is capable. of following in the horizontal direction 28 any inaccuracies that may have been caused when the one or other boxes 1, 14 is installed, as it is likewise capable of doing in the direction 29 along the bolt 23.

FIG. 4 shows the slot 27 in the view A (viewed vertically on the shaft plate 15). According to FIG. 4, the eye screw 21 can be shifted in the vertical direction 29 along the bolt 23, and in the horizontal direction along the slot 27. If angular rotation of the boxes 1 and 14 or of components of said boxes is feared, an adaptation in the respective peripheral direction 30 (in relation to the axis of the bolt 23) can be made possible as well, namely if the inside width of the eye 22 has corresponding play versus the diameter of the bolt 23.

LIST OF REFERENCE NUMERALS

1=Trench sheeting box
2=Trench plate
3=Spindle spreader
4=Trench
5=Inner surface (2)
6=Spreader bearing
7=Canal
8=Blade
9=Anvil edge
10=Longitudinal edge (2)
11=Tab
12=Bolt
13=Shaft
14=Shaft sheeting box
15=Shaft plate
16=Tongue
17=Tab
18=Bolt
19=Inner surface (15)
20=Longitudinal edge (16)
21=Eye screw
22=Eye
23=Bolt
24=Tab
25=Abutment
26=Outer surface (15)
27=Slot
28=Horizontal direction
29=Vertical direction
30=Peripheral direction (23)

What is claimed is:

1. A trench sheeting device for a trench comprising:

a) at least one trench sheeting box formed by at least two standard trench plates spaced apart from each other;

b) a plurality of spindle spreaders coupled to said at least two standard trench plates for and spreading apart said at least two standard trench plates;

c) at least one shaft sheeting box having a width exceeding a width of said at least one trench sheeting box, wherein said shaft sheeting box comprises:

i) at least two standard trench plates spaced apart from each other; and ii) at least one shaft plate extending substantially perpendicular to said at least two standard trench plates of said at at least one trench sheeting box; and e) a coupling between said at least one shaft plate and said at least two trench plates of said at least one trench sheeting box wherein said coupling allows for a horizontal and a vertical adjustment of said at least one shaft sheeting box and said at least one trench sheeting box in relation to each other.

2. The device as in claim 1, wherein said coupling comprises:

i) a vertically disposed first bolt; and ii) a second bolt, which is horizontally moveable within said shaft plate, and supported on said shaft plate and vertically moveably connected with said first bolt.

3. The trench sheeting device as in claim 2, wherein said second bolt further comprises an eye wherein said first bolt extends through said eye of said second bolt.

4. The trench sheeting device as in claim 2, wherein said at least one shaft plate contains a substantially horizontal slot disposed therein, wherein said second bolt extends through said substantially horizontal slot of said at least one shaft plate and said device further comprises an abutment for securing said second bolt within said substantially horizontal slot of said at least one shaft plate, said abutment for securing said first bolt from a plurality of forces originating from said trench plate and belonging to said trench sheeting box.

5. The trench sheeting device as in claim 1, wherein said coupling allows for rotation of said at least one trench sheeting box and said at least one shaft sheeting box in relation to each other.

6. The device as in claim 3, wherein said eye has a width that is substantially larger than said first bolt so that said at least one trench sheeting box and said at least one shaft sheeting box can rotate in relation to each other.

* * * * *